XR 3,974,794

TX114/242

United Stat

Kakitani et al.

[11] 3,974,794

[45] Aug. 17, 1976

[54] VACUUM ACTUATED SHIP MOORING DEVICES

[75] Inventors: Shigeyuki Kakitani; Tadashi Kishi; Takehiko Hirao, all of Kure; Norimitsu Takami, Hiroshima; Atsumu Shimizu, Kure; Keiichi Outeki, Yokohama; Masato Fujimoto, Kure, all of Japan

[73] Assignee: Ishikawajima-Harima Jukogyo Kabushiki Kaisha, Tokyo, Japan

[22] Filed: Nov. 1, 1974

[21] Appl. No.: 520,100

[30] Foreign Application Priority Data

| | | |
|---|---|---|
| Nov. 3, 1973 | Japan | 48-137955[U] |
| Nov. 6, 1973 | Japan | 48-128400[U] |
| Nov. 6, 1973 | Japan | 48-124779 |
| Nov. 6, 1973 | Japan | 48-128401[U] |
| Nov. 7, 1973 | Japan | 48-128697[U] |

[52] U.S. Cl. ..... 114/230; 114/206 R; 114/235 R

[51] Int. Cl.[2] ..... B63B 21/00

[58] Field of Search ..... 114/230, 231, 235 R, 114/235 A, 206 R, 219, 51; 248/206 R, 362, 363; 269/21; 294/64 R

[56] References Cited

UNITED STATES PATENTS

| | | | |
|---|---|---|---|
| 2,347,491 | 4/1944 | Lente | 114/51 |
| 2,871,053 | 1/1959 | Richter | 248/206 R |
| 3,051,117 | 8/1962 | Hunter | 114/206 R |
| 3,227,481 | 1/1966 | Creskoff | 294/64 R |
| 3,345,971 | 10/1967 | Stanwick | 114/235 R |
| 3,463,114 | 8/1969 | Lovell | 114/230 |
| 3,529,919 | 9/1970 | Tiraspolsky et al. | 114/206 R |
| 3,864,922 | 2/1975 | Dial et al. | 114/219 |

FOREIGN PATENTS OR APPLICATIONS

| | | | |
|---|---|---|---|
| 1,580,863 | 2/1968 | France | 114/230 |
| 1,558,977 | 11/1967 | France | 114/235 A |
| 797,653 | 7/1958 | United Kingdom | 114/230 |

*Primary Examiner*—George E. A. Malvosa
*Assistant Examiner*—Charles E. Frankfort
*Attorney, Agent, or Firm*—Scrivener Parker Scrivener & Clarke

[57] ABSTRACT

A suction cup assembly mounted on a mount which in turn is attached to a vessel or pier is attached to the pier or vessel and actuated by a vacuum pump or the like so as to make fast the vessel for towing or mooring without the use of the tow ropes or mooring ropes.

4 Claims, 23 Drawing Figures

Fig. 3
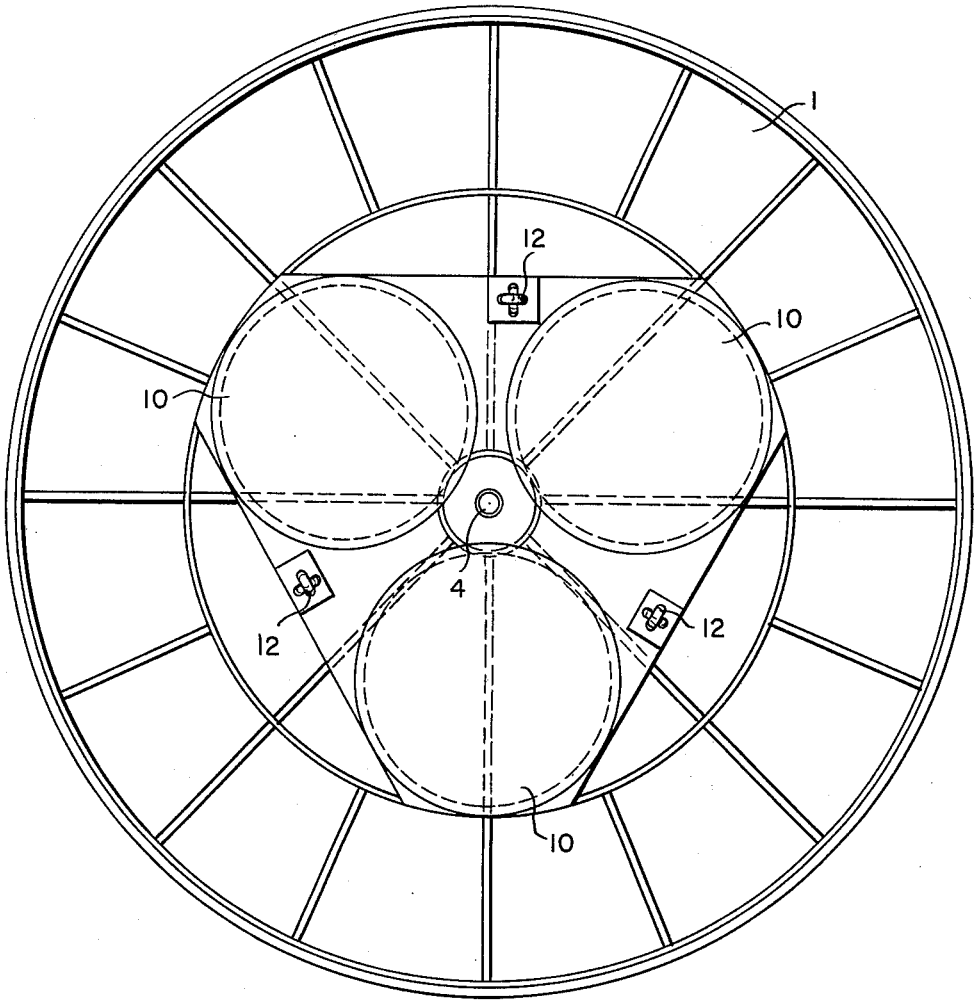
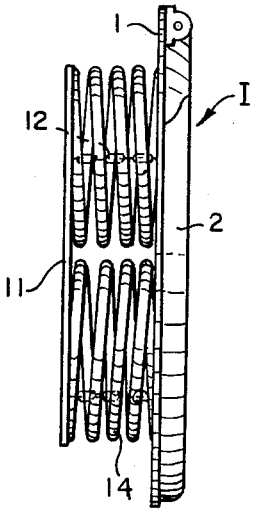
Fig. 4

Fig 9
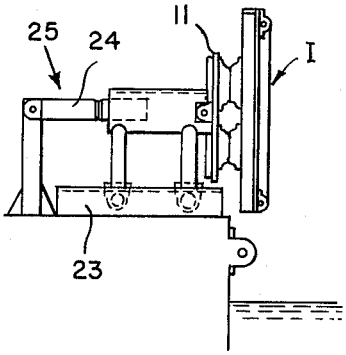
Fig. 10
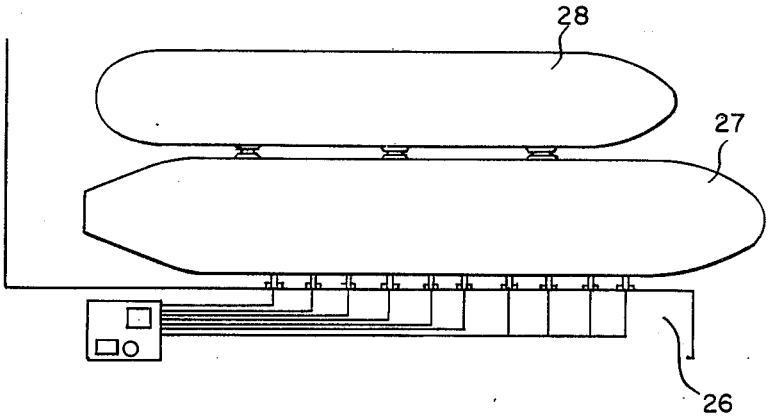
Fig. 11
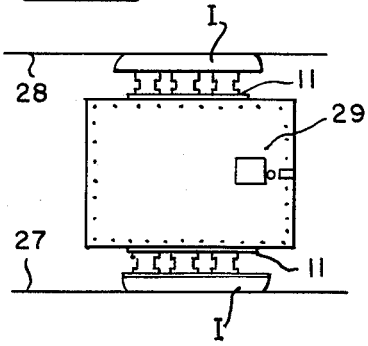
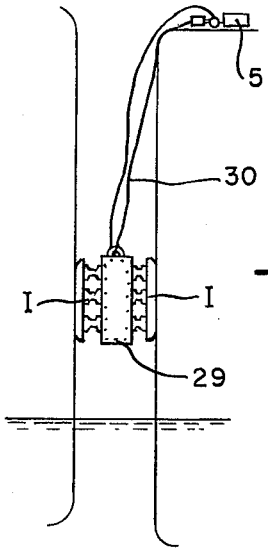
Fig. 12

Fig. 16
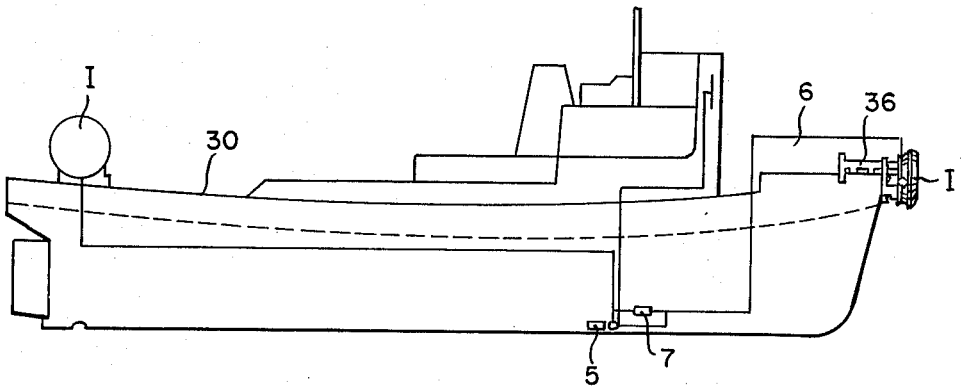
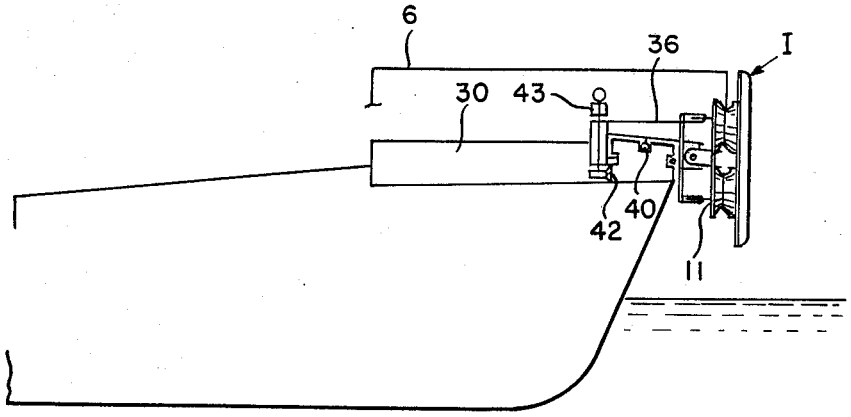
Fig. 17

Fig. 18
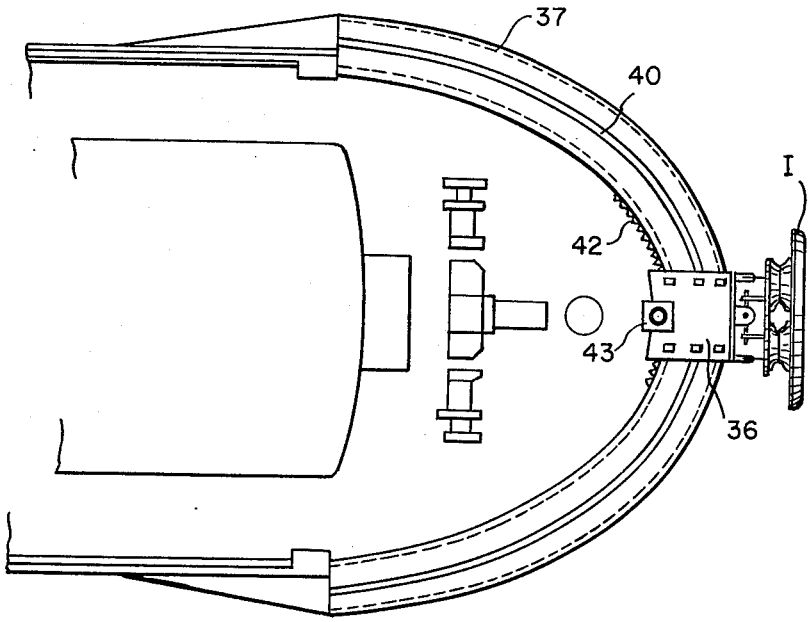
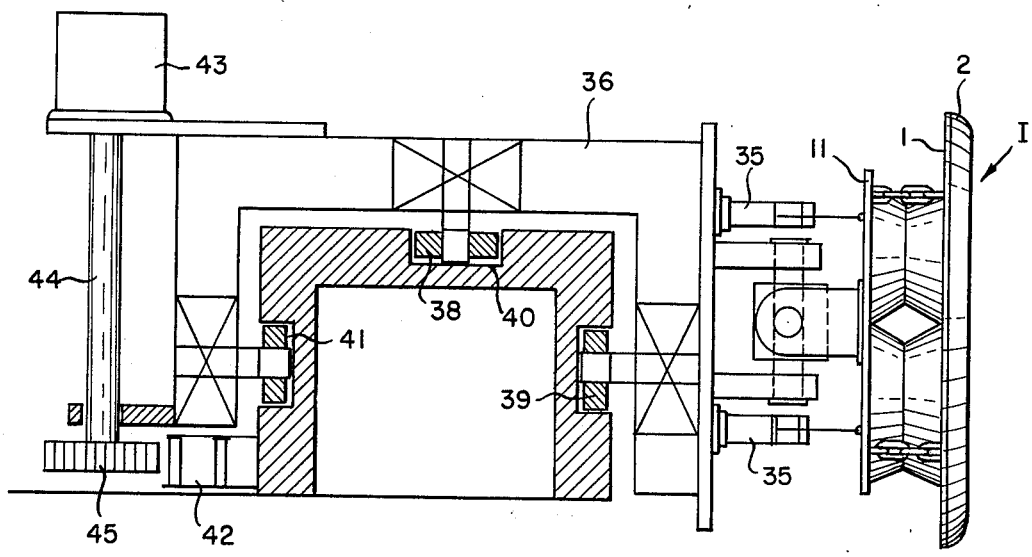
Fig. 19

Fig. 22
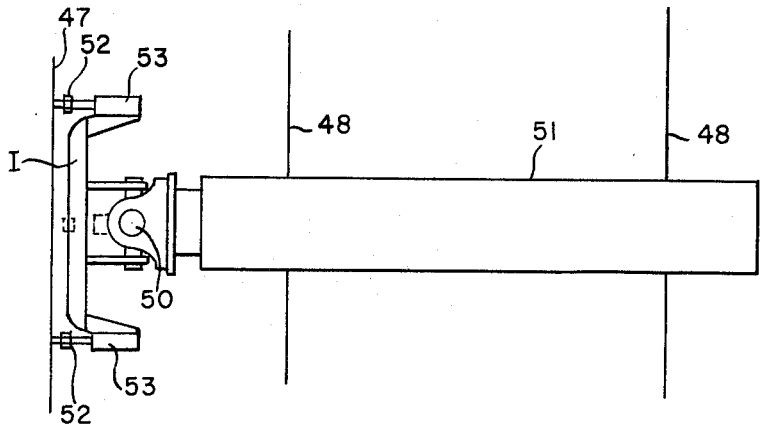
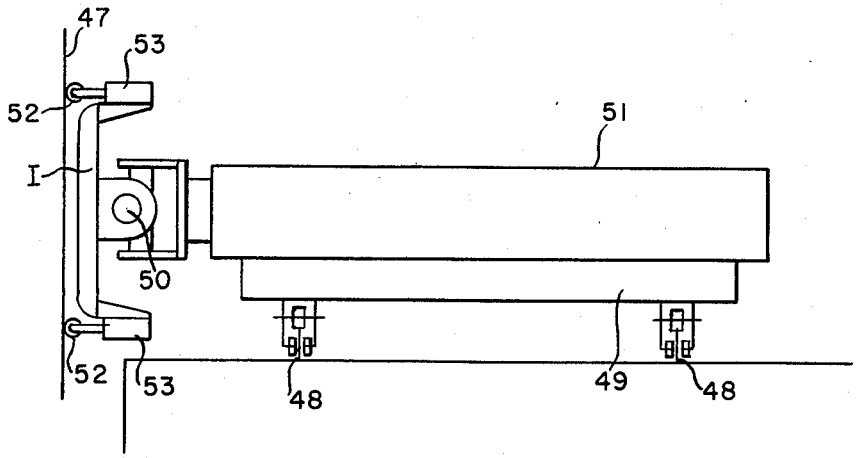
Fig. 23

VACUUM ACTUATED SHIP MOORING DEVICES

DETAILED DESCRIPTION OF THE INVENTION

In the harbors, the vessels are, in general, towed by a tug boat. That is, the tug boat directly pushes a vessel or tows a vessel with a tow rope. The vessel such as a floating crane and the like which is berthed along a vessel or a vessel which is berthed along a pier is, in general, moored with mooring ropes.

Large-sized towing and mooring ropes must be used for a mammoth-sized vessel, and the height of the mammoth-sized vessel is considerably higher than that of the tug boat so that the tow rope angle is increased. Therefore the number of crews of the tug boat must be increased and the safe towing operation becomes difficult. That is, since the large-sized tow ropes and mooring ropes are used, their handling becomes difficult and requires not only many operators but also a long time so that an accident tends to happen. Furthermore a suitable tow rope angle is not attained so that the towing efficiency of a tug boat is considerably decreased.

In order to overcome these problems, some of the newly built mammoth-sized vessels are provided with special towing bitts. However, in many cases the towing bitts are not located, owing to the draft of the vessel, at a position where the tug boat easily utilizes them. Thus the towing bitts are not so effective.

In view of the above, one of the objects of the present invention is to provide a mooring device which may eliminate the tow ropes and mooring ropes, and may berth a vessel along another vessel or pier or moor a vessel to a tug boat in a simple yet efficient and reliable manner and in various manners.

Another object of the present invention is to provide a mooring device which may sufficiently absorb the kinetic energies produced by the waves or the like.

A further object of the present invention is to provide a mooring device which may be easily attached to the curved hull surface.

A further object of the present invention is to provide a mooring device which may be displaced to a desired position and whose angular position may be suitably varied so that the suitable mooring or towing angle may be obtained.

The present invention will become more apparent from the following description of the preferred embodiments thereof taken in conjunction with the accompanying drawing in which:

FIG. 3 is a view looking in the direction indicated by the arrows A—A in FIG. 2;

FIG. 4 is a side view of the mooring device of the present invention adopted another embodiment to buffer members;

FIGS. 7 to 12 are views used for the explanation another use of the mooring device of the present invention;

FIG. 16 is a side view of a tug boat provided with a mooring device of another embodiment of the present invention;

FIG. 17 is a view illustrating, on enlarged scale, the bow portion thereof;

FIG. 18 is a top view thereof;

FIG. 19 is a side view, partly in section and on enlarged scale thereof;

FIG. 22 is a top view of the another embodiment; and

FIG. 23 is a side view thereof.

Figure 1:
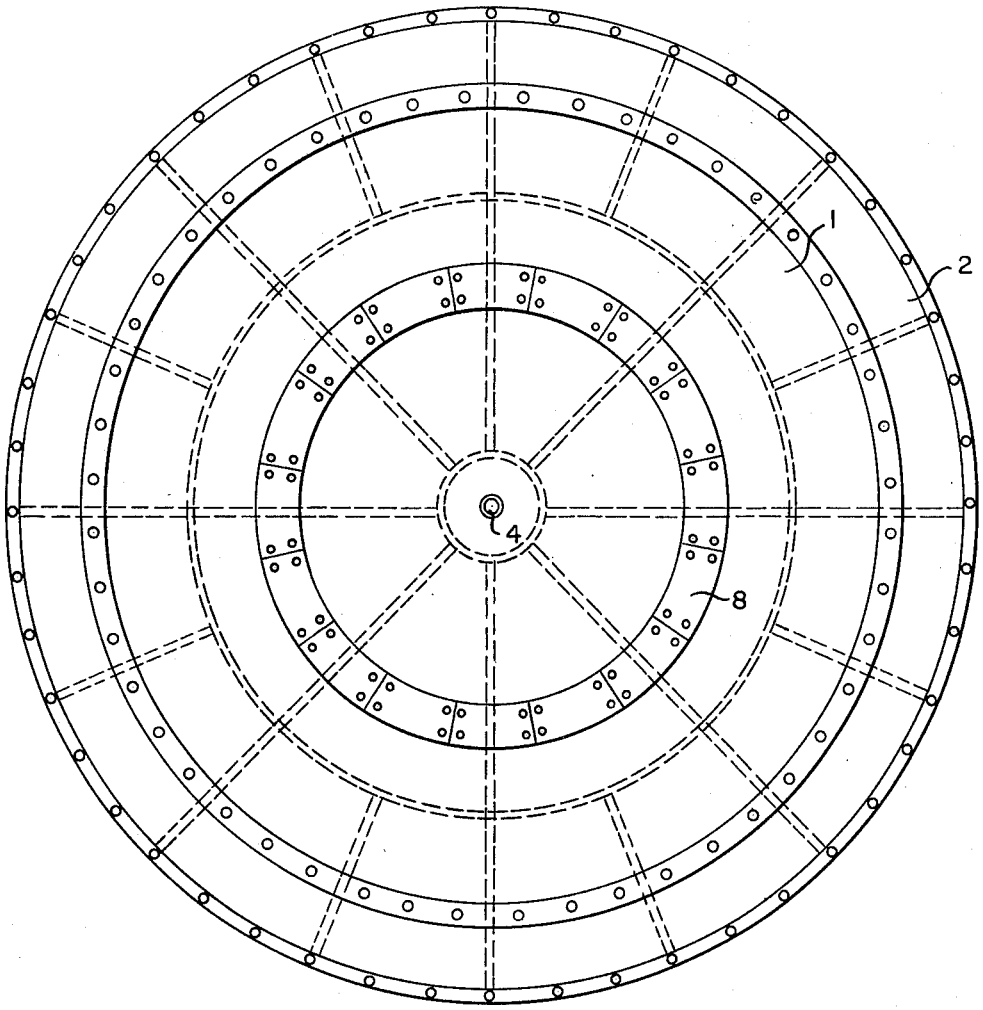
FIG. 1 is a front view of an embodiment of the present invention.
Figure 2:
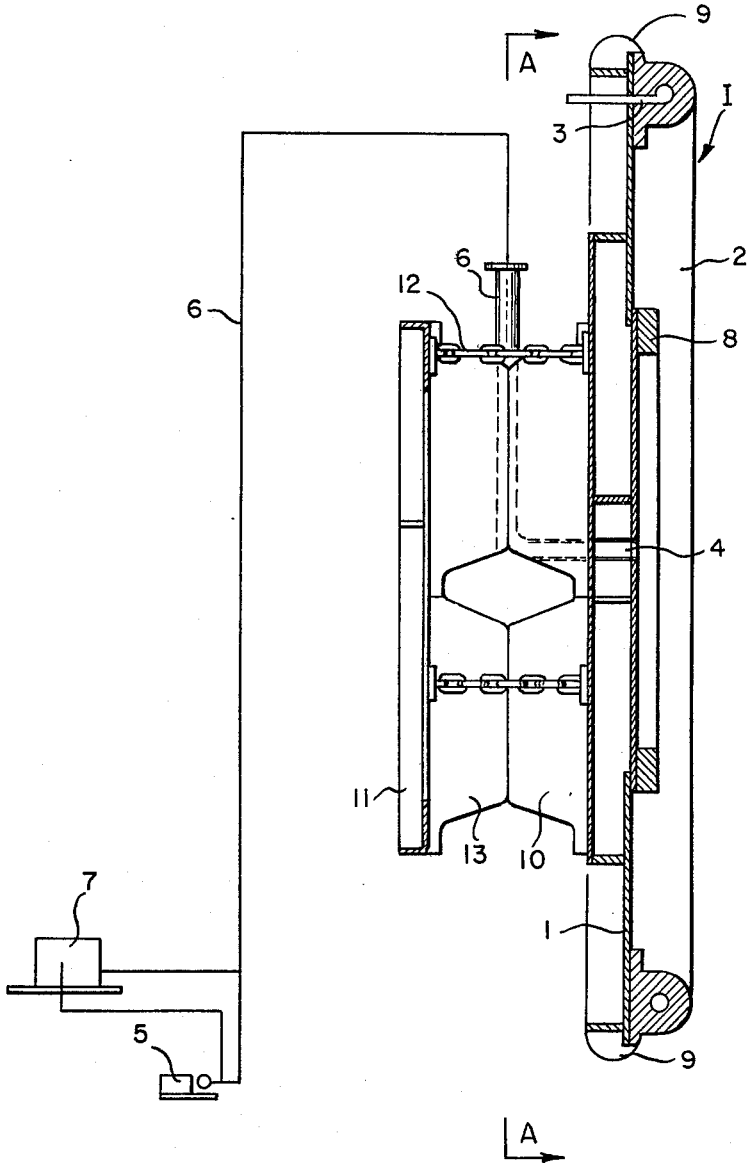
FIG. 2 is a sectional view thereof.

Referring first to FIGS. 1 through 3, a suction cup assembly generally indicated by I comprises a suction cup proper or main body 1 in any suitable shape (circular in the instant embodiment) and made of any suitable material such as steel, rubber or the combination thereof, and a ring-shaped hollow rubber lip 2 semi-circular in cross section and provided with an air port 3 for intercommunicating between the surrounding atmosphere and the hollow space in the lip ring 2 as best shown in FIG. 2 for the purpose to be described hereinafter. An air port 4 is formed at the center of the suction cup proper or main body 1 so that the air within the space defined by the suction cup proper or main body 1, the rubber lip 2 and the surface such as the hull's side or pier to which is attached the suction cup assembly I, may be evacuated through the air port 4, thereby firmly attracting the suction cup assembly I to the hull's side or pier. More particularly as best shown in FIG. 2 the suction cup assembly I is communicated through a pipe line 6 with a vacuum pump 5 so that a partial vacuum may be produced within the suction cup assembly I. When such partial vacuum is produced so that the suction cup assembly I is firmly attracted to the hull's side or pier, the rubber lip 2 is deformed and firmly pressed against the hull's side or pier so that the air-tightness of the suction cup assembly I may be ensured. In order to encounter the sudden decrease in degree of vacuum in the assembly I, a vacuum I, a vacuum tank 7 is inserted into the pipe line 6.

To release the suction cup assembly I from the hull's side or pier, the pipe line 6 is communicated with the surrounding atmosphere so that the pressure within the assembly I is returned to the atmospheric pressure. Thus the suction cup assembly I may be easily removed from the hull's side or pier, and the lip 2 may recover its normal shape.

As the rubber lip 2 is compressed when pressed against the hull's side or pier or it is expanded when relieved therefrom, the air within the rubber lip 2 is discharged through the air port 3 or the air enters therein through the air port 3. Therefore the rubber lip 2 may easily deform itself in response to the pressures exerted thereto.

To the suction cup assembly I with the above fundamental construction is additionally attached a ring-shaped fender 8 made of any suitable cup proper or main body I coaxially of the rubber lip 2, has a diameter and height smaller than those of the rubber lip 2. Therefore when the rubber lip 2 is further compressed by the external forces after it has been deformed under the maximum attracting force produced, that is, when the rubber lip 2 is so compressed that its height becomes nearly equal to that of the fender ring 8, the latter may bear, instead of the lip 2, the load exerted to the suction cup assembly I. That is, when the excess or over-deformation of the rubber lip 2 occurs, the ring-shaped fender 8 is pressed against the hull's side or pier so that the excess- or over-deformation of the rubber lip 2 may be prevented, with the result of the long service life thereof. Therefore the height of the ring-shaped fender 8 is determined depending upon the minimum compression of the rubber lip 2 under the maximum attracting force, that is at the maximum partial vacuum. Since the ring-shaped fender 8 is made of a hard rubber or the like, the over- or excess- compression of the rubber lip 2 may be prevented so that its service life may become longer.

Furthermore, in order to prevent the damage to the hull's side or pier, a ring-shaped side fender 9 may be attached to the other periphery of the suction cup assembly I as best shown in FIG. 2.

As shown in FIGS. 1 to 3, buffer members 10, which are so formed as to withstand the repeated expanding and compressing force, torsion, bending force, shearing force and so on, are attached to the back surface of the suction cup proper or main body I. In like manner, similer buffer members 13 are securely attached in opposed relation with the buffer 10 to the front surface of a supporting member 11 which in turn is attached to a tug boat or vessel. The suction cup assembly I and the supporting member 11 are interconnected with a plurality of chains 12 in such a manner that the buffer members 10 are made into close contact with the mating buffer members 13 on the supporting member 11. Therefore the impact or kinetic energy produced by the waves or the like interacting between the suction cup assembly I and the hull's side or pier may be absorbed by the buffer members 10 and 13. The chains 12 serve not only to hold the suction cup assembly I but also to limit the movements of the buffer members 10 and 13. Thus according to this embodiment, the buffer members 10 and 13 may effectively absorb the forces caused by rolling, pitching and heaving so that the mutual interference between the suction cup assembly and a vessel or pier to which is attached the assembly I may be suppressed.

As shown in FIG. 4, instead of the buffer members 10 and 13, a plurality of coiled spring members 14 capable of withstanding various repeated loads such as expansion, compression, torsion, bending and shear may be interposed between the suction cup assembly I and the supporting member 11.

Figure 5:
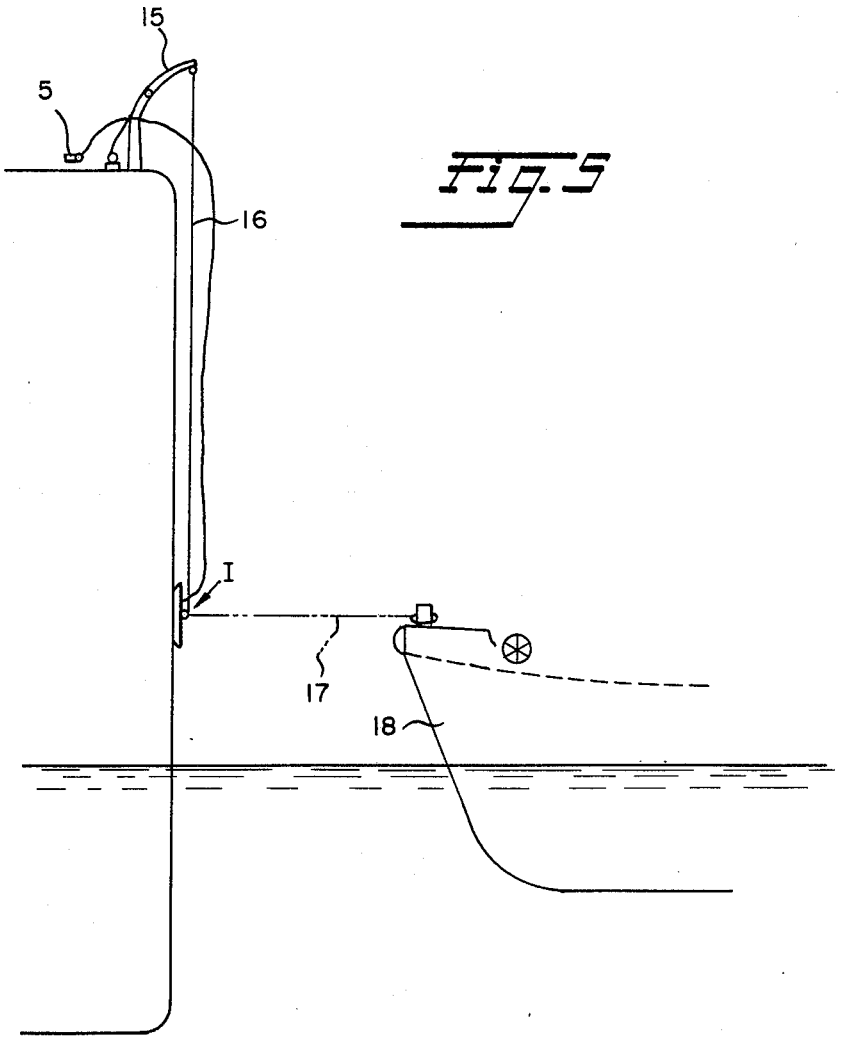
FIGS. 5 and 6 illustrate one example of the uses of the embodiments of the present invention.
Figure 6:
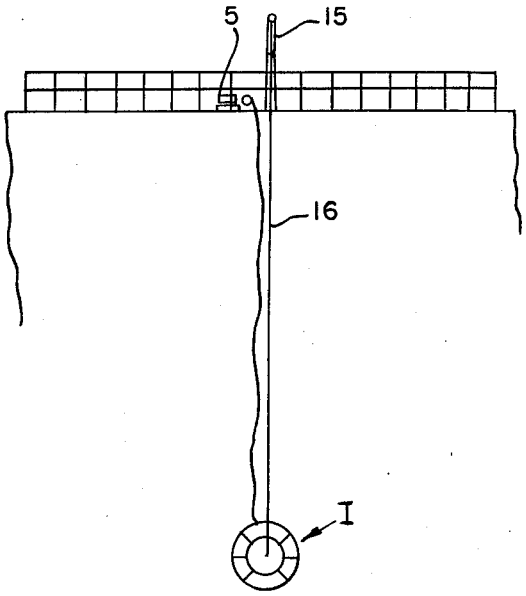

Next the modes of operation of the mooring devices with the above constructions will be described hereinafter. In case of the mooring device or suction cup assembly I without the buffer members 10 and 13, it is suspended from, for instance, a davit 15 by a rope or wire 16 and attached to the vessel's side at a suitable height from the sea level as shown in FIGS. 5 and 6. Therefore, the vacuum pump 5 (See FIG. 2) is driven to produce a partial vacuum in the suction cup assembly I, thereby causing the latter to firmly attach the vessel's side. Thereafter the suction cup assembly I is connected through a tow rope 17 to a tug boat 18. Thus the optimum tow line angle may be secured even when the tug boat is not provided with a suction cup assembly or mooring device in accordance with the present invention.

Figure 7:
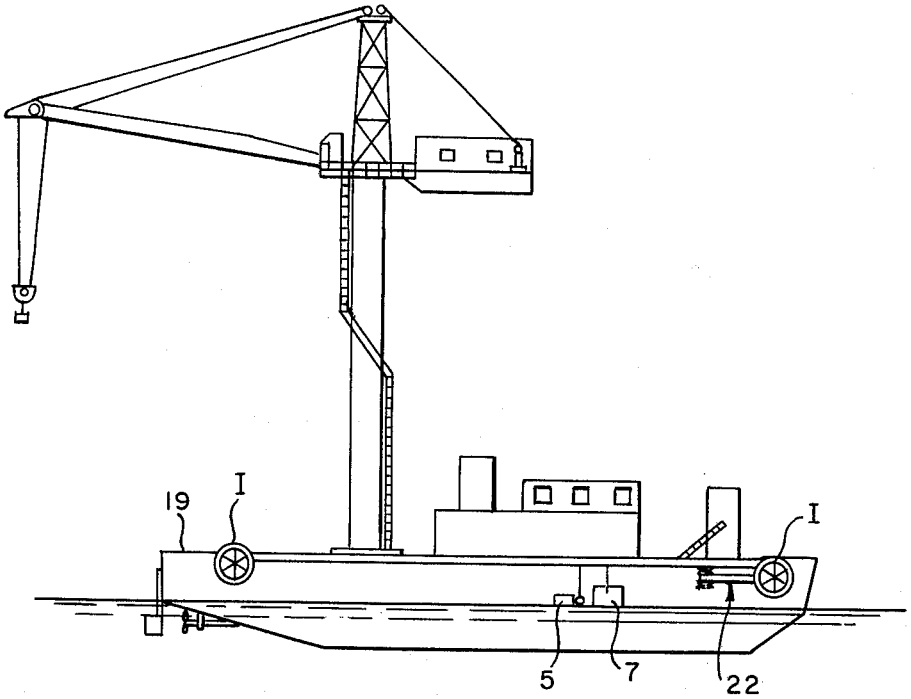
Figure 8:
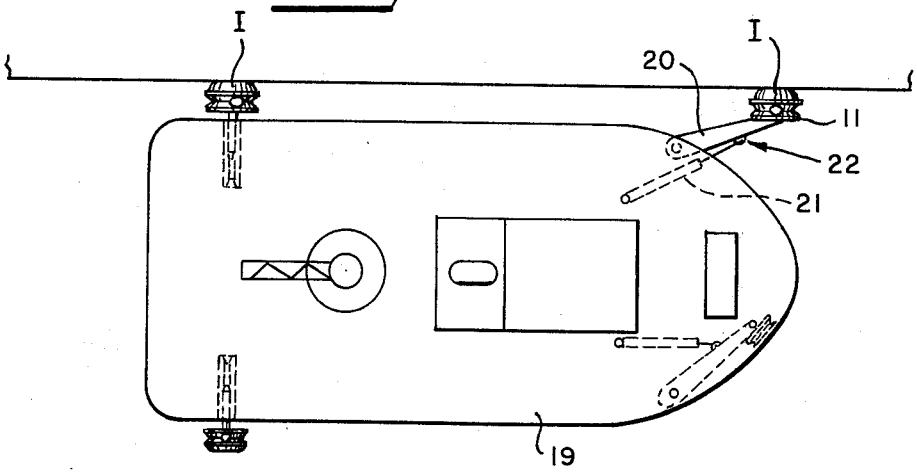

In case of the suction cup assemblies or mooring devices I of the type having the buffer members 10 and 13 or coiled springs 14, they may be movably attached to a floating crane 19 as shown in FIGS. 7, 8 and 9 so that the floating crane 19 may be made fast as best shown in FIG. 8. Each of mooring devices at both sides of the bow comprises a mount 22 comprising an arm 20 and a power or hydraulic cylinder 21 so operatively coupled to the arm 20 as to cause the latter to swing in a horizontal plane, and the suction cup assembly I whose supporting member 11 is attached to the leading end of the arm 20. Thus, the mooring device is extended out of and retracted into the floating crane as best shown in FIG. 8.

Each of the mooring devices at both sides of the stern comprises, as shown in FIG. 9, a mount 25 comprising a carriage 23 and a hydraulic cylinder 24 for moving the carriage 23 horizontally at a right angle of the vessel's side, and the suction cup assembly I whose supporting member 11 is attached to the carriage 23.

In operation, the mooring devices I are exrtended out of the floating crane 19, and attached to the side of another vessel or pier. Thereafter, the vacuum pump 5 is driven to cause the suction cup assemblies I to firmly attract the hull's side or pier so that the floating crane 19 may be secured in berth.

The other embodiment of the present invention is used for berthing a vessel 28 along another vessel 27 which in turn is berthed along a pier 26 as shown in FIG. 10. A mooring device in accordance with the embodiment comprises a pair of suction cup assemblies I whose supporting members 11 are attached in back-to-back relation to a supporting body 29 as best shown in FIG. 11.

In operation, a plurality of such mooring devices are suspended from either of the vessels 27 or 28 with ropes 30 between the sides of the adjacent vessels 27 and 28 as best shown in FIGS. 11 and 12. Thereafter the vacuum pump 5 is driven to cause the mooring devices to attract the vessels 27 and 28 to each other. Thus the vessel 28 may be securely berthed alonng the vessel 27.

Referring back to FIG. 10, a plurality of mooring devices are shown as being attached to the pier 26 to attact the vessel 27 so that the latter 27 may be securely berthed along the pier 26.

Figure 13:
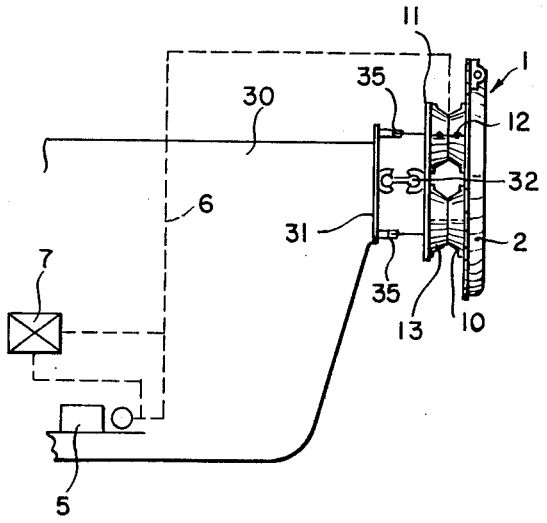
FIG. 13 is a side view of another embodiment of the present invention.
Figure 14:
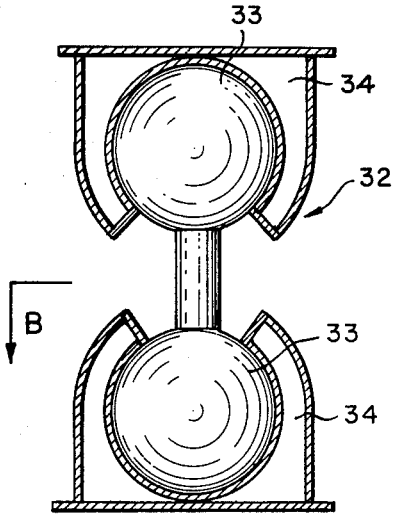
FIG. 14 is a cross sectional view; on enlarged scale, of a universal joint of the present invention shown in FIG. 13.
Figure 15:
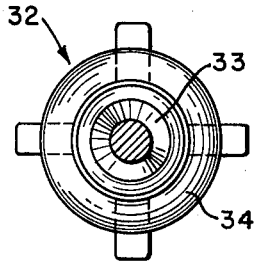
FIG. 15 is a view looking in the direction indicated by the arrow B in FIG. 14.

The most important feature of an another embodiment of the present invention to be described with reference to FIGS. 13, 14 and 15 resides in the fact that the suction cup assembly I may be positioned to conform to the curving hull surface or the inclined hull's side by presetting the suction cup assembly to an angle approximately that of the curving hull surface, prior to engagement of the suction cup assembly with the hull surface. That is, as shown in FIG. 13, the suction cup assembly I is mounted upon a mount 31 attached to a tug boat or vessel through a ball-and-socket joint 32 and a plurality of hydraulic cylinders 35 for swinging the suction cup assembly I in a desired angular direction. The ball-and-socket joint 32 used in the present invention comprises a dumbbell-shaped member 33 and socket members 34 which are attached to the supporting member 11 and the mount 31, respectively, and receive therein the ball sections of the dumbbell-shaped member 33.

When the mooring device of the type described is attached to a tug boat, the hydraulic cylinders 35 are so actuated as to swing the suction cup assembly I in such a way that it may be snuggly attached to the hull's side of a vessel to be towed. Therefore pushing or towing of a vessel by a tug boat may be much facilitated.

When the mooring devices of the type described are attached to a vessel, the suction cup assemblies I may be also swung to be snuggly fitted against the hull's side of another vessel or pier. Therefore the vessel may be securely berthed along another vessel or pier, and the mooring operation may be much facilitated.

Instead of the ball-and-socket joint 32, a universal joint may be used as best shown in FIG. 19.

It should be noted that the mooring devices of said embodiment may be attached to the mounts 22 and 25 of the type described hereinbefore with reference to FIGS. 8 and 9. It is also to be understood that the buffer members 10 and 13 may be eliminated and the suction cup assembly I and the mount 31 may be interconnected with each other through the universal joint 32 and a plurality of hydraulic cylinders 35.

According to an another embodiment of the present invention, the suction cup assembly I is mounted upon a mount 36 which is movable along a rail 37 laid at the bow of a tug boat 30 in the form of a semicircle as best shown in FIG. 18. Thus the suction cup assembly I may be moved along the semicircular rail 37 through 180° so that the optimum pushing or towing angle may be secured as will be described in detail hereinafter.

Referring to FIGS. 17 to 20, the rails 37 is laid in the form of a semicircle on the deck at the bow, and a wheeled carriage 36 rides on the rail 37. That is, wheels 38 and 39 of the carriage 36 are slidably fitted into guide grooves 40 and 41 formed in the rail 37 as best shown in FIG. 19 so that the carriage 36 may be movable along the rail 37 and prevented from derailing. A toothed rail 42 is laid inwardly and along the rail 37, and is in mesh with a driving gear 45 attached at the lower ennd of a driving shaft 44 of a driving device 43 which is mounted upon the carriage 36 and comprises, in general, a mc or and a reduction gear (both not shown). Therefo. when the driving device 43 is driven, the carriage 36 and hence the suction cup assembly I may be moved along the rail 37. The driving device 43 also comprises a clutch (not shown) so that the driving gear 45 may be selectively disengaged from the toothed rail 42.

Figure 20:
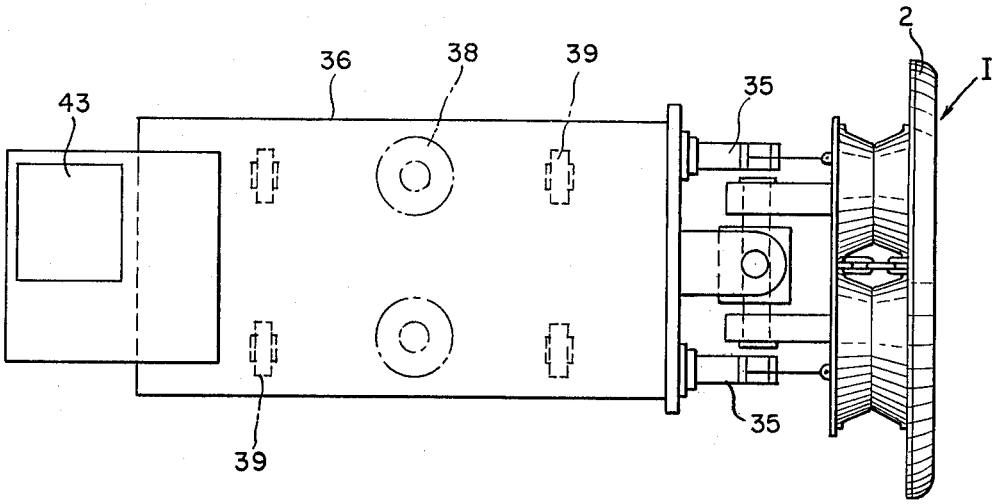
FIG. 20 is a top view thereof.

The suction cup assembly I is mounted upon the carriage 36 with the universal joint and the hydraulic cylinders 35 as best shown in FIGS. 19 and 20 in such a way that the suction cup assembly I amy be normally extended out of the board of the tug boat 30 at any angular position.

In operation, the clutch (not shown) is so actuated as to engage the driving gear 45 with the toothed rail 42, and the driving device 43 is driven so that the carriage 36 and hence the assembly I may be moved along the rail 37 to a desired position. When the mooring device is topped at a desired position, the vacuum pump 5 is driven to cause the suction cup assembly I to attract the hull's side of a vessel. The suction cup assembly I may swing in the manner described hereinbefore by operating the cylinders. Thus, the tug boat 30 may be moored to a vessel in a simple but positive manner with the optimum pushing or towing angle.

Figure 21:
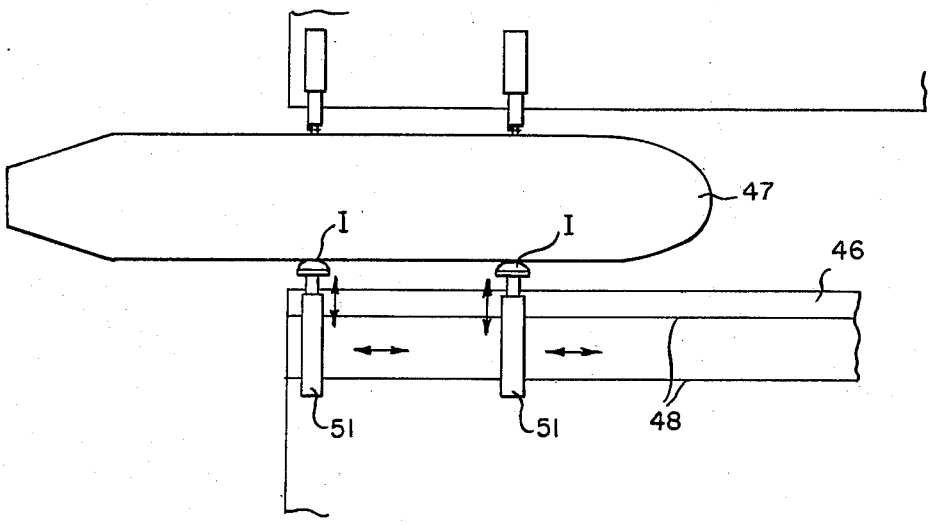
FIG. 21 is a view used for the explanation of another embodiment of the present invention.

The mooring devices of an another embodiment of the present invention to be described in detail hereinafter are adapted to be installed along a dock so as to facilitate the entering or departing of a vessel 47 into or out of the dock as best shown in FIG. 21. The suction cup assembly I is attached through a universal joint 50 to a transverse member 51 which is mounted upon a wheeled carriage 49 which in turn rides upon rails 48 laid on each side of the dock. The transverse member 51 comprises a hydraulic cylinder (not shown) so that it may be extended transversely of the carriage 49. A plurality of hydraulic cylinders 53 each having a guide roller 52 attached to the leading and of its piston are attached to the outer periphery of the suction cup assembly I.

In operation, the carriage 49 and hence the suction cup assembly I is moved to a desired position along the rails 48, and the transverse member 51 is extended so that the suction cup assembly I may be attached to the side of the vessel 47 entering into or departing from the dock. Thereafter the vacuum pump 5 is driven so that the suction cup assembly I may firmly attract the vessel 47. In like manner, other suction cup assemblies I are attached to the vessel 47 so that the latter may be fast in a simple manner. Thereafter the carriages 49 are moved along the rails 48 so that the vessel 47 may be entered into or departed from the dock. When the vessel 47 has entered into the dock, the attracting forces of the suction cup assemblies I are released, but the guide rollers 52 are pressed against the hull's sides under the forces of the hydraulic cylinders 53. Thus when the water in the dock is pumped out, the vessel 47 may vertically sink gradually along the guide rollers 52 and securely placed at the bottom of the dock without any vibration and inclination. Further, of course, it is possible to install the buffer members to the suction cup assemblies I and to make support the suction cup assemblies I to the transverse member 51 through the universal joint 50.

So far the mooring devices of the embodiment have been described as being installed along the dock, but it is to be understood that they may be installed along a pier so that the berthed vessel may be moved along the pier.

Since the suction cup assembly I is attached to the transverse member 51 through the universal joint 50, the angular position of the suction cup assembly I may be arbitrarily varied. It is to be understood that the hydraulic cylinders may be placed between the suction cup assembly I and the transverse member 51 so that the suction cup assembly I may be maintained at a desired angular position.

So far the embodiment and variations of the present invention have been described, but it is to be understood that the present invention is not limited thereto and that various modifications may be effected within the true spirit of the present invention. In the prior embodiment (See FIG. 18), the semicircular rail 37 has been described as being laid on the deck at the bow, but it may be of any shape and be laid at any place, for instance, on the deck at the stern or along the whole side of a vessel. Alternatively, the rail 37 may be attached to the side plating of a vessel. The toothed rail 42 has been described inwardly of and along the rail 37, but it is to be understood that the position of the toothed rail 42 may be suitably selected depending upon the dimensions of the suction cup assembly, the configurations of the carriage and the rail 37. The rail 37 has been described as having three guide grooves into which are fitted the wheels 38 and 39, but the number of guide grooves may be suitably selected as far as derailing of the carriage may be provented. In the embodiments (See FIGS. 13 through 20), the buffer members may be eliminated.

The mooring devices of the present invention with the above constructions may be summarized as follows;

i. Because of the positive and strong attracting force produced in a simple manner by the suction cup assemblies, a vessel may be made fast in a very simple manner.

ii. Since the suction cup assembly may assume various positions, a vessel may be moored in various manners.

iii. Even a mammoth-sized vessel may be moored by the suction cup assemblies so that towing or mooring may be much facilitated. The tow rope handling operation in the prior art mooring methods may be eliminated so that the labor-saving may be attained and the very efficient, safe and reliable towing or mooring may be ensured. Since the optimum towing angle may be attained, the power of a tug boat may be decreased.

iv. When the mooring devices in accordance with the present invention are installed on a vessel, various operations may be accomplished at any place (for instance within or without a harbor) independently of the mooring facilities.

v. The fender is provided in order to prevent the excess- or over-compression of the rubber lip so that the damage to the rubber lip may be prevented with the resulting long service life thereof.

vi. Since the buffer members are provided, the impact produced when a vessel is berthed along another vessel or a pier may be effectively absorbed. The kinetic energies produced by the waves or the like when a vessel is berthed may be also simply and positively absorbed.

vii. The position of the suction cup assembly may be moved to any desired place and its angular position may be varied so that the suction cup assembly may be attached any suitable position of a vessel.

viii. Since the suction cup assembly is mounted upon the mount in such a way that it may swing, the effective and positive mooring may be ensured.

ix. The angular position of the suction cup assembly may be maintained by the hydraulic cylinders.

x. When the suction cup assembly is mounted upon the self-propelled carriage on a tug boat or the like, it may be displaced to any desired position so that the optimum pushing or towing angle may be attained. Thus any type of vessel may be pushed or towed. Futhermore, the pushing or towing position may be changed very simply. Moreover the optimum berthing along the pier may be ensured.

xi. Because of the reason described in (x), the direction of the tug boat may be changed easily so that the hydraulic pressures exerted to the tug boat may be adjusted.

xii. When the mooring devices are installed along the dock, a vessel may be entered into or departed from the dock in a simple and efficient manner. Thus, labor saving may be also attained.

What is claimed is:

1. A device for mooring a ship comprising a mounting member, a suction cup assembly having a main body with two major surfaces, at least one continuous, circular lip rubber projecting outwardly from one major surface of said main body and defining a space in which a partial vacuum is produced by a vacuum pump when said suction cup assembly is attached to a surface of the ship, said suction cup assembly including a supporting member intermediate said mounting member and said main body, and means interconnecting the supporting member and said main body, means including a universal joint for supporting said suction cup assembly on said mounting member annd a plurality of power cylinders mounted on the mounting member and connected directly to the suction cup assembly whereby the assembly may be freely and positively moved in vertical and horizontal directions about said universal joint by actuation of said power cylinders, to position said suction cup assembly against the surface of the ship regardless of the curvature thereof.

2. A device as set forth in claim 1 wherein a fender is attached to said one major surface of said main body, said fender projecting outwardly from said one major surface a distance less than said lip rubber to limit compression of the latter.

3. A device as set forth in claim 2 wherein a plurality of buffer members are positioned between the other major surface of said main body of said suction cup assembly and said supporting member for absorbing impacts between the surface of the ship and the supporting member.

4. A device as set forth in claim 1 wherein a a plurality of buffer members are positioned between the other major surface of said main body of said suction cup assembly and said supporting member for absorbing impacts between the surface of the ship and the supporting member.

* * * * *

UNITED STATES PATENT OFFICE

CERTIFICATE OF CORRECTION

Patent No. 3,974,794 Dated August 17, 1976

Inventor(s) Shigeuyuki Kakitani; Tadashi Kishi; Takehiko Hirao; Norimitsu Takami; Atsumu Shimizu; Keiichi Outeki; Masato Fujimoto It is certified that error appears in the above-identified patent and that said Letters Patent are hereby corrected as shown below:

Column 2, Line 43, delete ..."a vacuum I"....

Column 2, Line 61, after "suitable" insert --material such as hard rubber. The fender 8, which is attached to the suction--

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*